US006452121B1

(12) United States Patent
Ogden

(10) Patent No.: US 6,452,121 B1
(45) Date of Patent: Sep. 17, 2002

(54) THREE-AXIS GRAVITY SWITCH HAVING A HEMISPHERICAL CHAMBER

(76) Inventor: Everett Ogden, P.O. Box 2721, Ponte Vedra Beach, FL (US) 32004

( * ) Notice: Subject to any disclaimer, the term of this patent is extended or adjusted under 35 U.S.C. 154(b) by 0 days.

(21) Appl. No.: 09/723,191

(22) Filed: Nov. 27, 2000

Related U.S. Application Data

(63) Continuation-in-part of application No. 09/247,266, filed on Feb. 10, 1999, now Pat. No. 6,281,456.
(60) Provisional application No. 60/074,286, filed on Feb. 11, 1998.

(51) Int. Cl.[7] ..... H01H 29/22; H01H 35/02
(52) U.S. Cl. ..... 200/61.46; 200/200; 200/226; 200/233; 200/277; 200/61.52
(58) Field of Search ..... 200/189, 222, 200/223, 224, 226, 233, 61.11, 61.46, 61.52, 277

(56) References Cited

U.S. PATENT DOCUMENTS

| | | | | |
|---|---|---|---|---|
| 3,836,739 A | | 9/1974 | Endo | |
| 4,445,011 A | * | 4/1984 | Hansen | 200/224 X |
| 4,565,010 A | * | 1/1986 | Herman | 33/366.24 |
| 5,373,125 A | * | 12/1994 | Ford et al. | 200/61.52 |
| 5,533,520 A | * | 7/1996 | Inguaggiato | 200/61.45 R X |

* cited by examiner

*Primary Examiner*—Renee Luebke
(74) *Attorney, Agent, or Firm*—Thomas C. Saitta

(57) ABSTRACT

A three-axis gravity switch having a curved chamber with an inner wall in the shape of a convex hemisphere and an outer wall in the shape of a concave hemisphere which retains a gravity responsive member such as a ball of liquid mercury, the chamber having a three-dimensional sensing pathway defined on at least one of its walls, where the gravity responsive member and pathway are conductive, either electrically or optically, such that a circuit is completed when the gravity responsive member contacts the pathway, where the switch can be rotated, inverted and translated in three dimensions such that the pathway defines an acceptable three dimensional course of rotation for the switch.

25 Claims, 9 Drawing Sheets

THREE-AXIS GRAVITY SWITCH HAVING A HEMISPHERICAL CHAMBER

This application is a continuation-in-part of U.S. patent application Ser. No. 09/247,266, filed Feb. 10, 1999, which clawed the benefit of U.S. Provisional Application Ser. No. 60/074,286, filed Feb. 11, 1998, now U.S. Pat. No. 6,281,456, issued Aug. 28, 2001.

BACKGROUND OF THE INVENTION

This invention relates to sensors or switches which utilize the fact that gravity will maintain an unrestricted conductive contact element, such as a metal ball or a ball of liquid mercury or other electrically conductive liquid, in the lowermost position relative to its containment chamber to indicate attitudinal position of the switch or sensor relative to true vertical, and correspondingly the attitudinal position of any object attached thereto. More particularly, the invention is a sensor which is able to monitor the attitudinal position of an object relative to true vertical over a three axis pathway, such that a single sensor can monitor the movement over the pathway even if the object and sensor are inverted or tilted in any plane, and regardless of whether the object is fixed in space or moved positionally.

There are many situations where it is necessary or desired to monitor or sense the attitudinal position of an object relative to true vertical. Switches or sensors which utilize the effect of gravity on a ball of liquid mercury or an electrically conductive metal ball or roller are well known, the switch being designed such that the unrestricted conductive member makes or loses contact with a pair of leads in an electrical circuit dependent on the attitude of the switch relative to true horizontal, such that either contact with the leads or loss of contact with the leads which occurs when the attitudinal position of the switch is altered relative to vertical results in a signal or other electrical action occurring. Such switches or sensors are commonly referred to as mercury or gravity switches. Such simple gravity switches work when the object or switch is tilted or rotated about a non-vertical line, such that the switch is activated or deactivated when a particular angle relative to vertical is exceeded and gravity causes movement of the conducting ball away from or against the contact leads. In order to track attitudinal positioning of an object along various curved pathways in the orthogonal X-Y-Z three axis world, where the switch is rotated, tilted and/or inverted, the known solution is to attempt to combine a number of such two dimensional switches, with the switches oriented in opposing directions. Any such solution, especially when the object is inverted, requires determination of sequential activation and deactivation scenarios, since certain of the switches will be non-functional or provide incorrect signals when the object passes through various positions relative to vertical.

It is an object of this invention to provide a single gravity-type sensor switch which monitors the position of an object over a three dimensional pathway which extends dimensionally about all three orthogonal axes where the object may be tilted, rotated or inverted, as well as translated through space rather than maintained at a fixed location, so as to provide a signal to indicate that the object is moving in the correct three dimensional manner. It is a further object to provide such a switch which contains a gravity controlled contact member which remains at the bottom of the sensor because of gravity as the position of the sensor changes relative to true vertical, where the sensor comprises a curved contact pathway corresponding to the desired three dimensional movement path of the object, where the contact member is contained within a curved tube, in particular a 360 degree torus having a circular transverse cross-section, or a pair of matching curved surfaces which can be part or all of a sphere, a combination of multiple curved surfaces or of any three dimensional curvilinear pathway in space. It is a further object to provide such a switch where the gravity responsive member is composed of a conductive liquid ball or bead immersed in a carrier liquid, where the material comprising the conductive liquid ball is immiscible in the liquid carrier. It is a further object to provide such a switch where the switch operates by sensing the difference in resistivity between the conductive liquid ball and the carrier liquid.

SUMMARY OF THE INVENTION

The invention is a gravity-type sensor switch where a gravity responsive member remains in the lowermost portion of a retaining chamber as the switch is moved through space. The gravity responsive member, which may be a ball of liquid mercury or other conductive liquid, an electrically conductive solid metal ball or roller, or similar type object, is retained within a defined curvilinear chamber having at least one conductive pathway mounted along one of the walls of the chamber which allows for relative movement between the gravity responsive member and the pathway as the attitudinal position of the switch relative to true vertical changes, true vertical being defined as the line passing through the switch and the gravitational center of the earth. A sensing pathway is formed along the curved walls such that a completed electrical circuit is produced when the sensing pathway is moved to be in contact with the gravity responsive member. The sensing pathway may comprise a number of discrete contact points or lead pairs positioned along the pathway, or it may comprise a pair of continuous conductive strips or wires, either embedded on the surface of the walls or disposed into the interior of the chamber, or it may comprise a single set of contact points, a wire or a strip in combination with a conductive surface on the curved wall of the chamber. The chamber walls may comprise the interior wall of a curved tube, such as a 360 degree torus having a circular transverse cross-section, or a pair of curvilinear, equidistantly spaced walls having matching surfaces, or a hemisphere or a spherical surface. The wall pairs may comprise a sphere within a sphere, a section of a sphere within a sphere, or any configuration of paired curvilinear walls. The curved tube may comprise a portion of a circle or may be spiraled or curved in multiple curves of differing radii.

The sensing pathway occupies at least two orthogonal dimensions and enables the sensor to function regardless of tilt, rotation or inversion. The particular sensing pathway is determined by the desired positional movement of the object to be monitored. The zero position, defined to be the position of the gravity responsive member relative to the remaining components of the sensor at any moment in the movement path of the object, i.e., the lowest possible position for the gravity responsive member within the retaining walls for a given attitudinal position, is determined for the object's entire movement pathway. With this information, the proper sensing pathway can be constructed on the chamber walls so that as the object is moved through three dimensions, the sensor pathway will be repositioned relative to the gravity responsive member, which has a fixed spatial attitude due to gravity. As long as the object is moved in the correct pathway, the gravity responsive member will remain in contact with the sensing pathway and the electrical circuit will be maintained. If the object is moved out of the predetermined pathway, the gravity responsive member will not remain in contact with the sensing pathway and the circuit will be broken. Alternatively, the sensor can be designed such that movement in the proper pathway results in no contact with the contacting element, with the sensing pathways arranged to provide a complete circuit only when the object is incorrectly moved. The presence or absence of an electrical circuit is used to provide a signal or indication, or can be used to actuate other electrical devices to effect desired results. The switch may also be constructed using optical components such as a combination of photosensors and defined light sources, receivers and emitters, whereby the gravity responsive element becomes an opaque blocking element between the light sources and the photosensors when properly positioned.

In a preferred embodiment, the switch is constructed with the gravity responsive member being an electrically conductive liquid ball or bead disposed within a non-conductive carrier liquid, the conductive liquid ball and the carrier liquid being immiscible such that the conductive liquid ball maintains a spherical or relatively spherical configuration, and where the conductive liquid ball is of greater density or specific gravity than the carrier liquid, such that the conductive liquid remains at the bottom of the liquid carrier. For example, the conductive liquid bead may be composed of ethylene or propylene glycol, with the carrier liquid being a silicone oil. Rather than providing a completed circuit, a switch utilizing a liquid ball gravity responsive member in a carrier liquid may be provided with circuitry to sense the difference in resistivity of the gravity responsive member versus the carrier liquid, with the result determining if the switch creates an open or closed operational circuit.

DETAILED DESCRIPTION OF THE INVENTION

Figure 1:
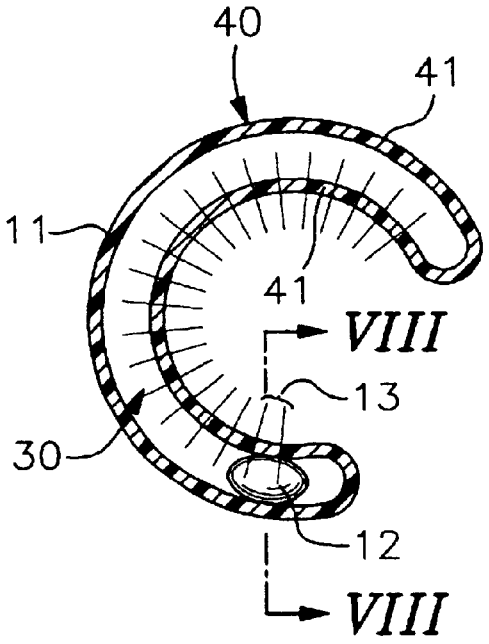
FIG. 1 is view of the tubular embodiment of the invention, showing the contact pathway as a series of discrete lead pairs.

The invention will now be described in detail with regard for the best mode and preferred embodiment, reference being made to the accompanying drawings. In general, the invention comprises a switch, or when in combination with suitable power and signal or control elements, a sensor, having a chamber 40 having opposing curved walls 41 to retain a gravity responsive member 12 which is free to move within the chamber 40 and which occupies the lowermost position in the chamber 40, and a conductive sensing pathway 30 along at least one of chamber walls 41 and typically on opposing walls 41, or suspended within the interior of chamber 40, the pathway 30 extending in three dimensional directions, where the pathway 30 defines a course of rotation over all three axes for the switch such that the gravity responsive member 12, dependent on the orientation of the switch relative to true vertical, either contacts or does not contact the pathway 30, thus either completing or opening a circuit. The sensing pathway 30 is connected in standard manner to an operational electrical or electronic circuit such that the device operates as a switch to activate or deactivate a given operation.

As seen in FIGS. 1 through 6 and 8 through 9, the switch comprises a tubular member 11 with closed ends which define curved opposing walls to retain the gravity responsive member 12. Tubular member 11 is preferably constructed of non-conducting material such as plastic. The gravity responsive member 12 is a conductive member, preferably consisting of a ball of liquid mercury, but the device may also be constructed using an electrically conductive metal ball or roller, or like object, which completes an electrical circuit when in contact with a conductive sensing pathway 30.

Figure 3:
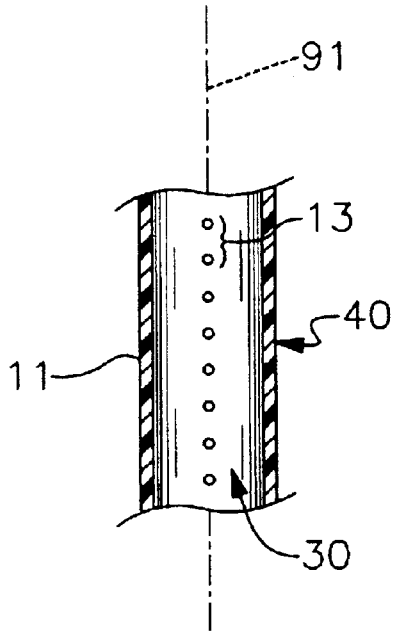
FIG. 3 is a cross-sectional view of a section of FIG. 1, showing the sensing pathway as positioned on the radial line.
Figure 8:
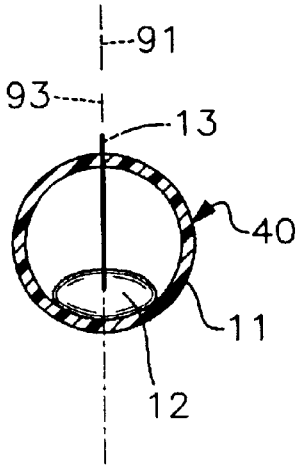
FIG. 8 is a cross-sectional view taken along line VIII—VIII of FIG. 1, showing the positioning of the gravity responsive member relative to the sensing pathway when the sensing switch is maintained in the proper position.
Figure 9:
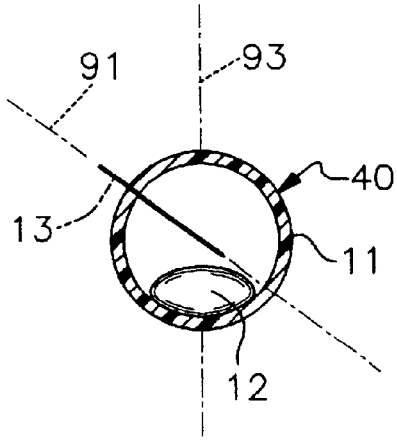
FIG. 9 is a cross-sectional view similar to FIG. 8 showing the positioning of the gravity responsive member relative to the sensing pathway when the sensing switch is tilted beyond the proper positional alignment.

FIGS. 1 and 3 illustrate a simple version of the sensor switch, where the pathway 30 comprises paired pin contact electrical lead members 13 extending into the interior of the chamber 40 through a curved wall 41, which although not shown would be arranged in circuit with an electrical power source, such as a battery, such that when the gap between any paired set of electrical leads 13 is closed by contact of the gravity responsive member 12, the current will flow to produce a desired electrical response, such as a signal or indication. The electrical leads 13 are arranged along the radial line 91 taken from the midpoint of the circle enclosed by tubular chamber 40 which bisects the chamber 40, as shown in FIG. 3. The radial line 91 and thus the conductive pathway 30 is in the plane of the circle. As the switch is rotated about its central axis, the gravity responsive member 12 remains at the lowermost position relative to true vertical 93, and successive pairs of leads 13 come into contact with the gravity responsive member 12 so long as the switch, and the object to which the switch is attached, is rotated within the vertical plane, as shown in FIG. 8. If however the switch is tilted out of the proper plane of rotation, then the gravity responsive member 12 will no longer contact the leads 13 and the electrical circuit will be broken, as shown in FIG. 9.

Figure 2:
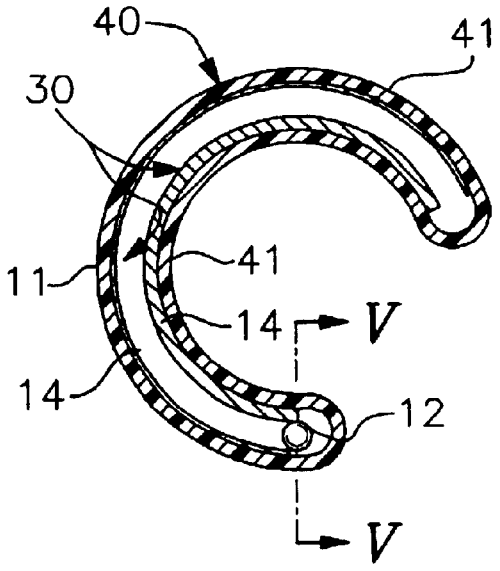
FIG. 2 is a view of the tubular embodiment showing the sensing pathway as a pair of opposing conductive strips.
Figure 5:
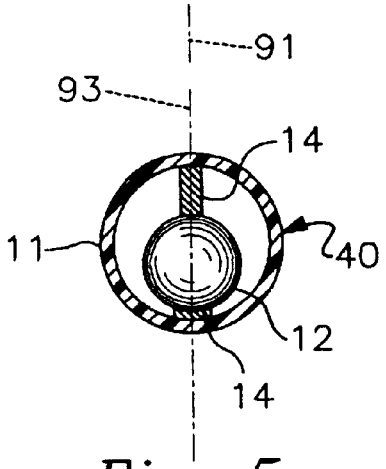
FIG. 5 is a cross-sectional view taken along line V—V of FIG. 2, showing the positioning of the gravity responsive member relative to the sensing pathway when the sensing switch is maintained in the proper position.
Figure 6:
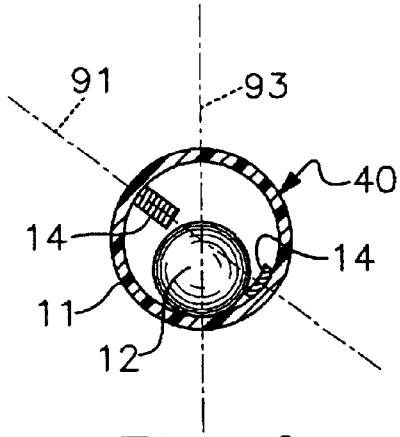
FIG. 6 is a cross-sectional view similar to FIG. 5 showing the positioning of the gravity responsive member relative to the sensing pathway when the sensing switch is tilted beyond the proper positional alignment.

FIG. 2 shows an alternative embodiment, where the sensing pathway 30 is formed by a set of opposing strips 14 which extend out from the opposing curved walls 41 of the chamber 40. Here the opposing strips 14 would be connected in a powered electrical circuit, not shown, such that a closed electrical circuit is created from one strip 14 to the opposing contact strip 14 through gravity responsive element 12, a metal ball. FIGS. 5 and 6 illustrate respectively a closed electrical circuit with the sensing switch maintained in the proper alignment and an open electrical circuit when the switch is tilted improperly such that contact between the conductive pathway 40 and the gravity responsive element 12 is broken.

Figure 4:
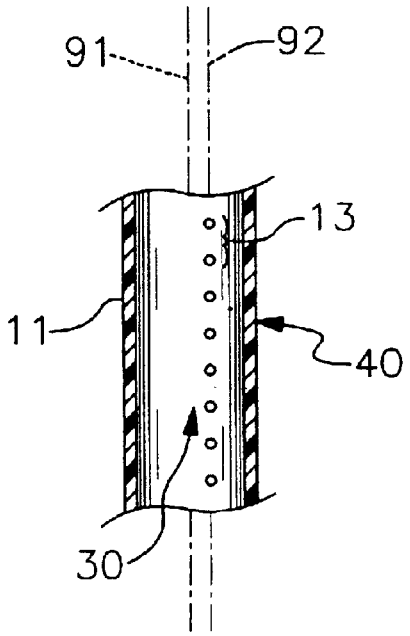
FIG. 4 is a view similar to FIG. 3, showing the sensing pathway as positioned some degrees off the radial line.
Figure 10:
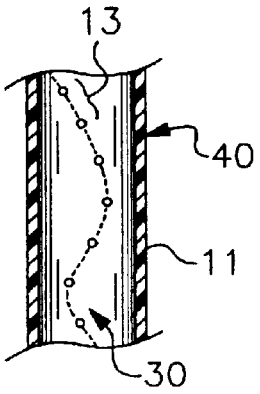
FIG. 10 is a view similar to FIG. 3, where the sensing pathway is curvilinear and formed of electrical lead pairs.
Figure 11:
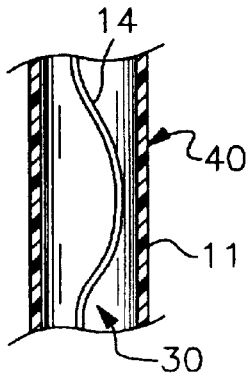
FIG. 11 is a view similar to FIG. 3, where the sensing pathway is curvilinear and formed of a conductive strip material.
Figure 12:
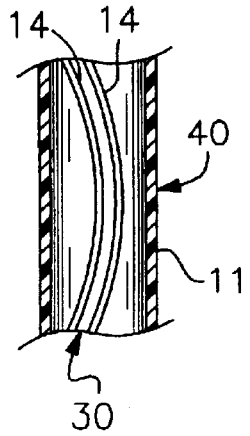
FIG. 12 is a view similar to FIG. 3, where the sensing pathway is a pair of curvilinear strips.
Figure 13:
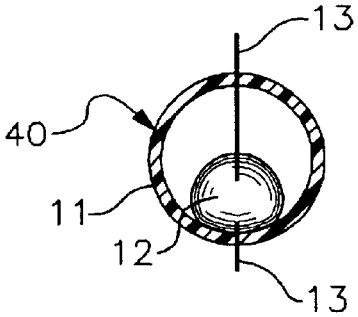
FIG. 13 is a view similar to FIG. 3, showing electrical contact leads positioned on opposing walls.

As depicted in FIGS. 1 and 2, the switch can be rotated through approximately 270 degrees without loss of function. The tubular member 11 could be constructed of shorter or longer arc lengths, and could even be configured as a full 360 degree ring. This embodiment functions to sense attitudinal position relative to true vertical 93. The sensitivity of the switch, i.e., the angular variation allowed from true vertical before electrical contact is broken is determined by the length of the extension of the contact leads 13 into the interior of the tube 11 and the size of the gravity responsive element.

Where the desired movement pathway of the object is planar but not vertical, as in the case of a golf swing, the placement of the contact leads 13 is altered as shown in FIG. 4. For example, a proper golf swing for any of the full distance shots requires that the club be rotated approximately 270 degrees from a zero degree starting position with the club held straight down, then brought backwards through horizontal, past vertical to an almost horizontal stopping point, with the swing pathway reversed in order to strike the ball. In addition, the swing plane is tilted from true vertical about 30 to 45 degrees and each portion of the club changes its position in space, i.e., there is no point on the club itself corresponding to a single fixed axis or fixed pivot point. Monitoring of the entire swing with regard for the proper swing plane is desirable to ensure that the swing is properly made. Here the leads 13 forming pathway 30 are not positioned along radial line 91 but instead are positioned along offset line 92, which is a predetermined number of degrees from radial line 91. With this construction, the proper movement pathway is on a slanted plane, and the sensing pathway 30 defined by the contact leads 13 mimics that plane relative to true vertical. If the switch is maintained at the proper alignment angle, even during inversion and position change through 270 degrees, the gravity responsive member 12 will remain in contact with the pathway 30 and an electrical circuit will be maintained.

Where the desired movement pathway is not planar but occurs over a three axis pathway, similar adjustments are made to the sensing pathway 30 along the length of the tubular member 11. Any sort of curving, spiraling or even abrupt angle change in the desired movement pathway is mimicked by the pathway 30, such that the sensing pathway 30 corresponds to the desired object movement pathway, such as shown in FIGS. 10 through 12. In FIG. 10, the sensing pathway 30 is formed of contact pin pairs 13, where the circuit is closed when the gravity responsive member 12 connects any given pair of pins 13. In FIG. 11, the sensing pathway 30 is comprised of a pair of strips 14, where the circuit is closed when the gravity responsive member 12 connects the gap between the strips 14. FIG. 12 shows the pathway 30 as formed by two sets of spaced conductive strip pairs 14 where the circuit is open when the switch is maintained in the proper position and closed should the gravity responsive member 12 contact either pair of strips 14 of pathway 30. The strips 14 can be preformed wires or foil members which are adhered or bonded to the wall of the chamber 40 in suitable known manner, or the strips 14 may be created directly on the wall of the chamber 40 by suitable known deposition techniques, such as masked spraying. Alternatively, the strips 14 may be created by forming the chamber 40 of a conductive material and mask spraying a non-conductive coating onto the wall of the chamber 40 with the strips 14 left as exposed members. With these constructions, the switch can be rotated, inverted and tilted through differing angles from true vertical. The gravity responsive member 12 remains at the zero position throughout all the switch movement, and maintains the completed electrical circuit so long as it is in contact with the pathway 30.

Figure 7:
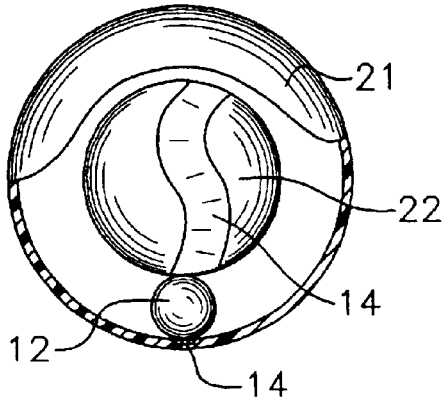
FIG. 7 is a partially exposed view of an embodiment of the invention where the pathway walls are formed by a pair of spherical surfaces.
Figure 30:
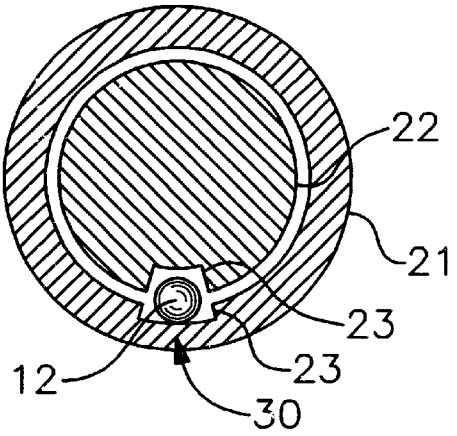
FIG. 30, is a cross-sectional view of a spherical switch where the sensing pathway is formed by a pair of channels.

In another alternative embodiment, shown in FIG. 7, the tubular member 11 is replaced by an inner spherical surface 22 inside an outer spherical surface 21, each defined as portions of a sphere. The gravity responsive member 12 will always remain at the lowermost gravity position as the switch is turned in any direction. As before, sensing pathway 30 is laid out to correspond to the desired movement pathway of the switch. The switch can be constructed with contact lead pins 13 and a liquid mercury contact element 12 as discussed above, of may be constructed as shown in the drawing using a pair of opposing contact strips 14 to form the pathway 30 with the circuit completed by a metal ball or liquid mercury gravity responsive member 12. If the switch is turned such that the gravity responsive member 12 does not contact both strips 14, the circuit will be broken. As before, any desired movement pathway can be replicated on the surfaces of 21 and 22. An alternative embodiment is shown in FIG. 30, where the sensing pathway 30 is formed by a pair of opposing grooves or channels 23, with the surfaces 21 and 22 being formed of a conductive material. When the metal ball gravity responsive member 12 contacts either of the sides of the channels 23, the circuit is completed.

Figure 14:
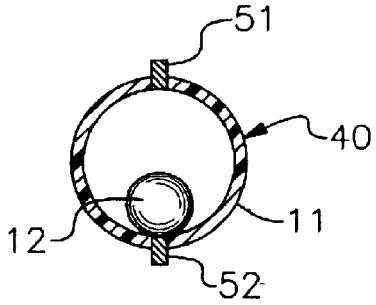
FIG. 14 is a view similar to FIG. 3, showing the pathway formed by optical emitters and receivers.
Figure 15:
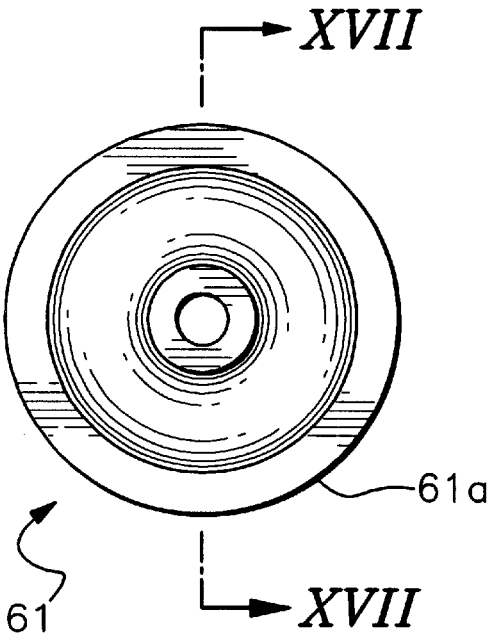
FIG. 15 is a side view of a switch configured as a 360 degree torus which is circular in transverse cross-section.
Figure 16:
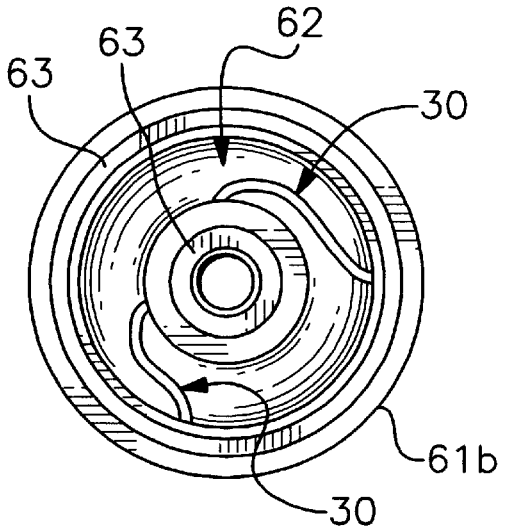
FIG. 16 is an interior view of one half of the body of the switch of FIG. 15.

Another alternative embodiment for this type of sensing switch involves the use of optical circuits rather than electrical circuits, as shown in FIG. 14. The sensing pathway 30 is formed in the opposing walls 41 by oppositely positioned light emitting and light receiving elements 51 and 52, with the gravity responsive member 12 being an opaque ball acting to block light reception between oppositely mounted emitter 51 and receiver 52 when the switch is in the proper alignment, thus breaking the circuit.

Movement of the gravity responsive element 12 within the switch can be slowed or damped by the addition of oil or a similar fluid. The sensitivity of the switch is affected by the depth of the pathway 30 and the size of the gravity responsive element 12.

Figure 17:
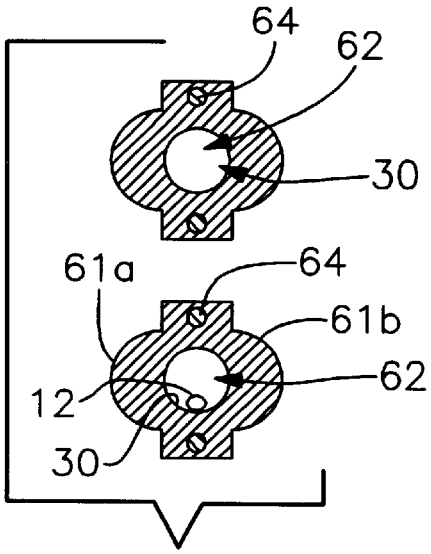
FIG. 17 is a transverse cross-sectional view of the switch of FIG. 15 taken along line XVII—XVII.
Figure 18:
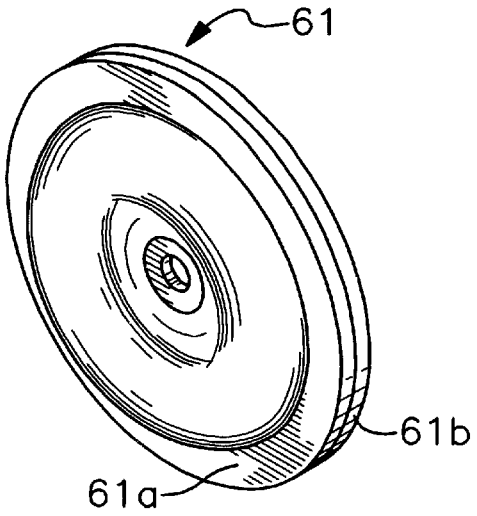
FIG. 18 is a perspective view of the switch configured as a 360 degree torus, circular in transverse cross-section.

A preferred tubular embodiment is illustrated in FIGS. 15 through 18, where the switch comprises a housing 61, which may be comprised of two mating halves 61*a* and 61*b* as shown, which defines a toroidal chamber 62. Chamber 62 is a 360 degree torus having a circular transverse cross-section, as seen in FIG. 17. In simpler terms, chamber 62 has the shape of a doughnut or ring. The housing halves 61*a* and 61*b* are provided with grooves 63 to receive O-rings 64 to seal in the gravity responsive member 12 when a liquid conducting material is used. As described above, various conductive elements such as pins or strips are positioned within the chamber 62 to define the three-axis sensing pathway 30. With the chamber extending completely full circle, the switch can function when rotated more than 360 degrees about the central axis of the housing 61.

While liquid mercury, being a metal in liquid form, works very well to complete the electrical circuit in the switch, mercury is a hazardous material and is therefore undesirable from a practical and environmental standpoint. A most preferred embodiment for the gravity responsive member 12 is that of an electrically conductive liquid immersed within a non-conductive carrier liquid. The conductive liquid is immiscible in the carrier liquid and of a different specific gravity/density, such that the conductive liquid maintains a generally spherical shape within the carrier liquid. Thus the conductive liquid forms a ball or bead which remains cohesive within the carrier liquid, with the ball or bead being denser than the carrier liquid such that it remains at the bottom of the carrier liquid. By utilizing the combination of the conductive liquid to form the gravity responsive member 12 within the carrier liquid, less hazardous materials may be utilized. It is most preferred that the conductive liquid and the carrier liquid be relatively viscous, as this precludes separation of the conductive liquid ball if the switch is shaken. A preferred combination is that of ethylene or propylene glycol for the conductive liquid and a silicone oil for the carrier liquid. Other conductive liquids, such as silver nitrate or salt water for example, may be used. Toluene or benzene are examples of other possible carrier liquids.

Figure 31:
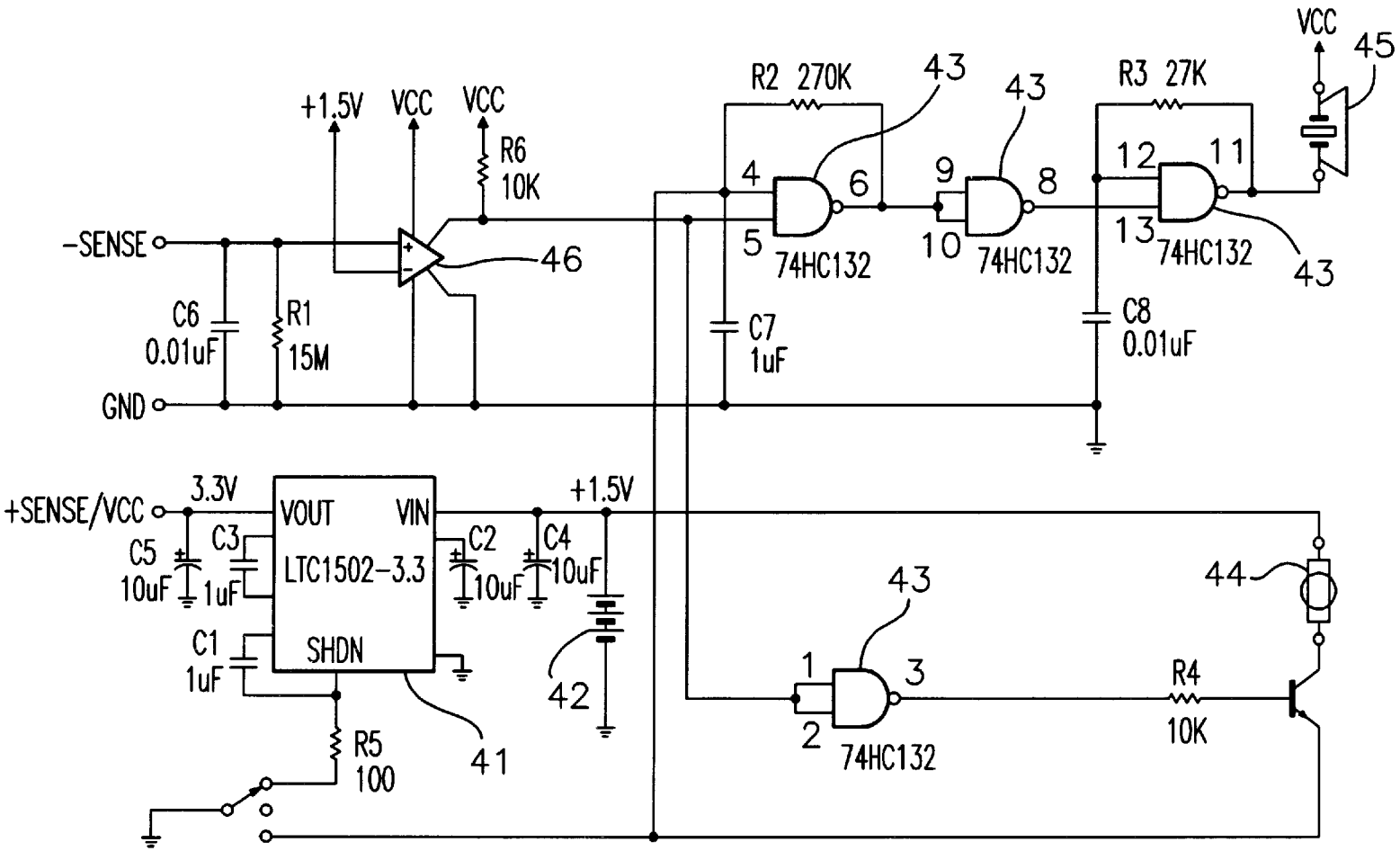
FIG. 31 is a schematic representation of a resistivity sensing circuit.

Because the conductive liquid materials used to replace the liquid mercury are typically much less conductive, it is most preferred that the switch utilize an electronic circuit to measure or sense the change in resistivity of the different liquids, with the electronic circuit then closing or opening a circuit for operational purposes in response to the different resistivity values. As shown in FIG. 31, which is a representative example of a battery powered resistivity sensing circuit, the resistivity sensing means 40 determines the status of the switch such that the switch is operational if the resistivity drops, which occurs when the conductive liquid bridges the gap in the sensing pathway 30. In this schematic element 41 is a DC to DC power supply chip to step up the voltage from the battery 42, element 43 is a quad nond-gate with Schmitt trigger inputs, and operative elements which as shown consist of a vibratory motor means 44 and an audible signal producing means 45. FIG. 11 further includes a comparator element 46 for sensitivity due to the high impedance of the electronic circuit 40.

Figure 19:
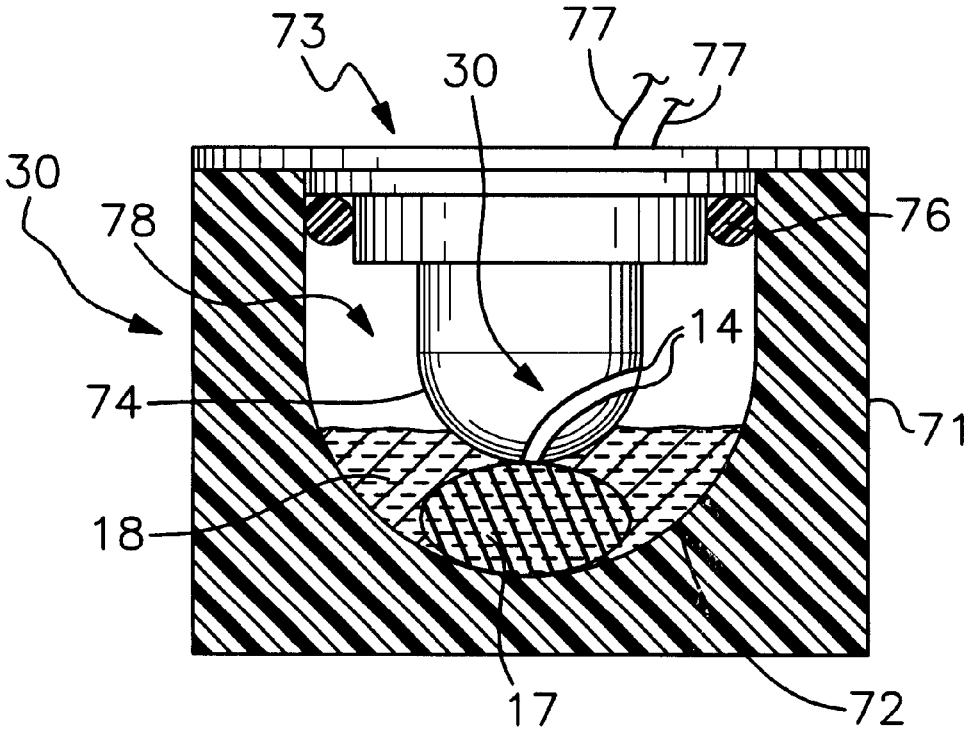
FIG. 19 is a view of a hemispherical chamber switch, with the base member, O-ring, gravity responsive conductive liquid and carrier liquid shown in cross-section, where the sensing pathway is formed as a pair of strips or wires embedded onto the surface of the interior member.

An alternative embodiment of a switch 70 having a hemispherical chamber 78 is illustrated in FIGS. 19 through 21, 28 and 29. The hemispherical switch 70 is formed preferably of a two parts, an outer body 71 and an inner member cap 73. Outer body 71 defines a concave chamber outer wall 72 which is hemispherical. The inner cap member has a sealing flange 75 which mates with the outer body 71 to form a sealed housing to retain a liquid gravity responsive member 12, which may comprise a single material but which is shown as a conductive liquid member 17 immersed within a carrier liquid 18, the liquid member 17 having a higher specific gravity or density than the carrier liquid 18, such that it remains as a bead or ball in the bottom of the carrier liquid 18. An O-ring 76 is disposed between the sealing flange 75 of the inner member cap 73 and the outer body 71. The inner member cap 73 most preferably terminates in a convex hemispherical chamber inner wall 74, such that the chamber 78 is defined by the separation between the chamber inner wall 74 and the chamber outer wall 72. In FIG. 19, the sensing pathway 30 is defined by a pair of strips 14, such as foil ribbons or wires positioned or formed on the chamber inner wall 74, with external leads 77 connected to the strips 14 and extending from the cap member 73. Alternatively, the strips 14 could be embedded in the chamber outer wall 72. In this embodiment the outer body 71 and the inner member cap 73 are formed of non-conductive material, such as PTFE or similar non-wetting plastics. When the switch 70 is disposed in physical space such that the sensing pathway 30 is in contact with the conductive liquid member 17, the circuit will be completed. When the switch 70 is disposed such that the sensing pathway 30 is not in contact with the conductive liquid 17, which always remains at the lowermost position due to gravity, the circuit is not completed. In the embodiment utilizing resistivity changes, the circuitry recognizes the difference in resistivity between the conductive liquid 17 and the carrier liquid 18 to determine whether the operational circuitry will be activated or not.

Figure 20:
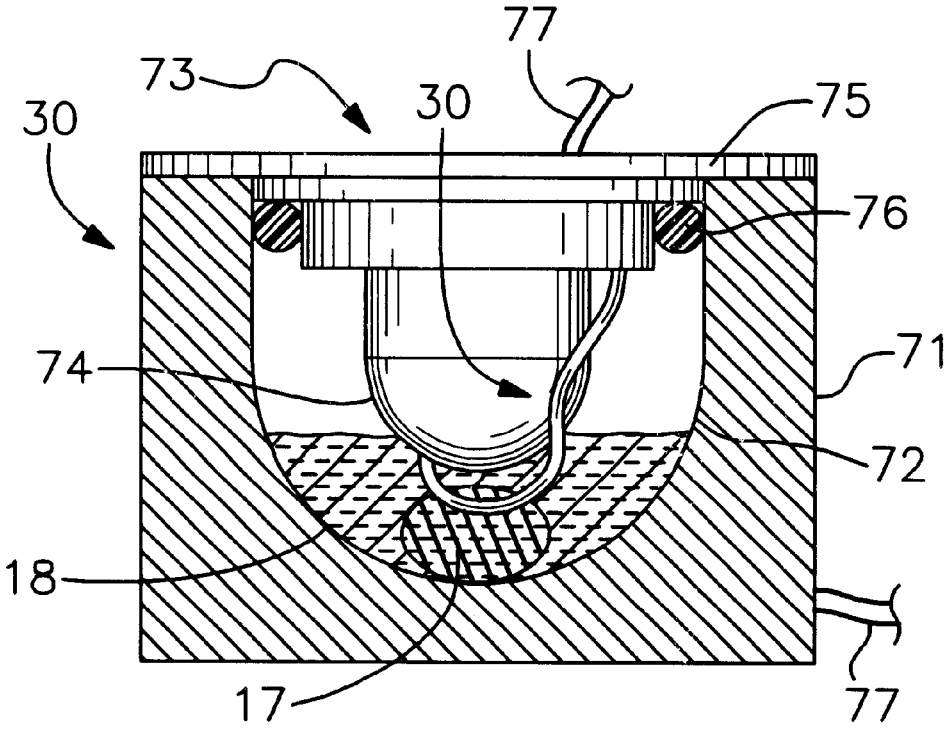
FIG. 20 is a view of a hemispherical chamber switch, similar to FIG. 19, where the sensing pathway is formed as a combination of a single wire disposed within the chamber, where the base member is composed of a conductive material.
Figure 29:
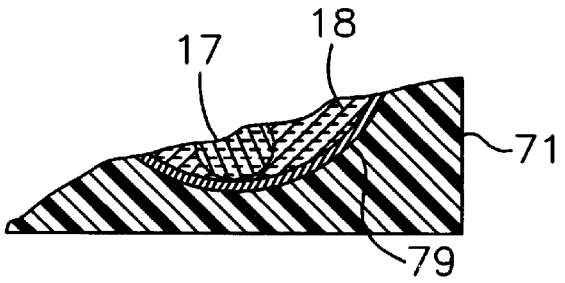
FIG. 29 is a partial view of a hemispherical switch similar to FIG. 27, where the outer chamber wall comprises a conductive layer.

In the embodiment shown in FIG. 20, the outer body 71 is formed of a conductive material, such as metal, or the chamber outer wall 72 is coated with a conductive layer 79, as shown in FIG. 29, with an external lead 77 provided which connects the chamber outer body 71 or the conductive layer 79 to the external circuitry. In this embodiment the sensing pathway 30 is defined by a single wire 15 disposed within the chamber 78, that is, separated or suspended from either the chamber inner wall 74 or the chamber outer wall 72 so that is resides within the chamber 78 interior. When the switch 70 is positioned such that the wire 15 is in contact with the conductive liquid member 17, the circuit is closed. Alternatively, the conductive layer 79 could be applied to the chamber inner wall 74 or the inner member 73 itself made of conductive material with the outer body 71 being non-conductive.

Figure 21:
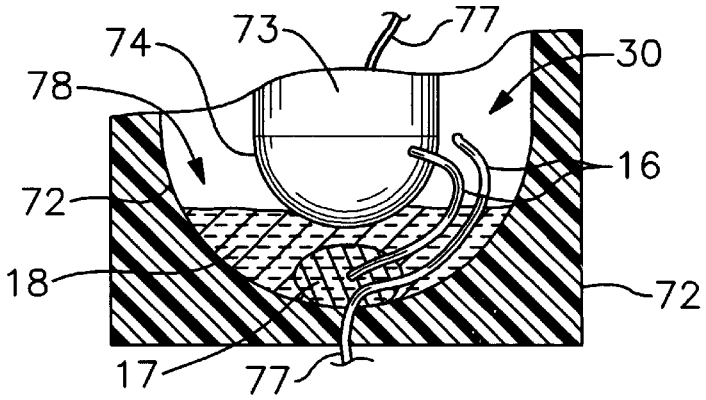
FIG. 21 is a partial view of a hemispherical chamber switch, similar to FIG. 19, where the sensing pathway is formed as a pair of wires disposed within the chamber.

In the embodiment shown in FIG. 21, the sensing pathway 30 is formed as a pair of disposed or suspended wires 16 which are positioned separated a distance from the chamber inner wall 74 and the chamber outer wall 72 and thus disposed within the interior of chamber 78. The wires 16 are substantially parallel, such that a circuit is completed when the conductive liquid member 17 is in contact with both wires 16. In the illustration, the wire pair 16 is shown where one wire 16 comes from the outer body 71 and the other wire 16 comes from the inner cap member 73, but both wires 16 could extend from the cap member 73 or both wires 16 could extend from the outer body 71.

Figure 28:
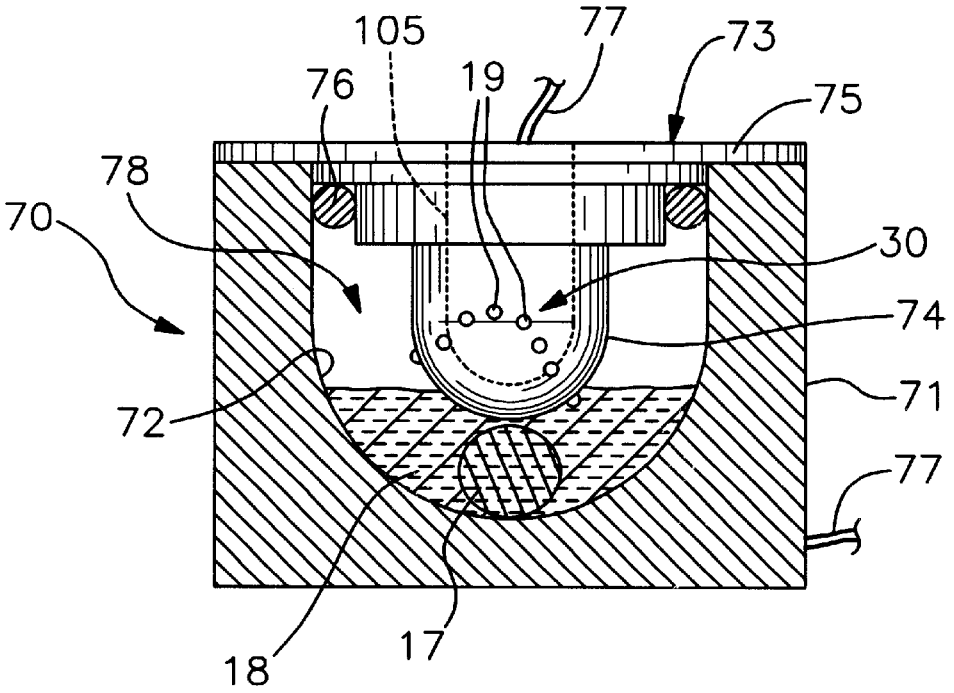
FIG. 28 is a view of a hemispherical chamber switch, similar to FIG. 19, where the sensing pathway is formed as a series of contact points on the chamber inner wall, where the base member is composed of a conductive material.

FIG. 28 shows a hemispherical switch 70 where the sensing pathway 30 is defined by a series of contact points 19. The contact points 19 are pins or post members inserted into the chamber inner wall 74 and are of sufficient length to extend completely through the chamber inner wall 74 and into bore 105 disposed within the inner member cap 73. The bore 105 is filled with solder or other conductive material and contacts the interior ends of the contact points 19. An external lead 77 is connected to solder. The outer body 72 is formed of a conductive material or provided with a conductive layer, as shown in FIG. 29. When the switch 70 is oriented such that any of the contact points touch the conductive liquid 17, the circuit is completed.

Figure 22:
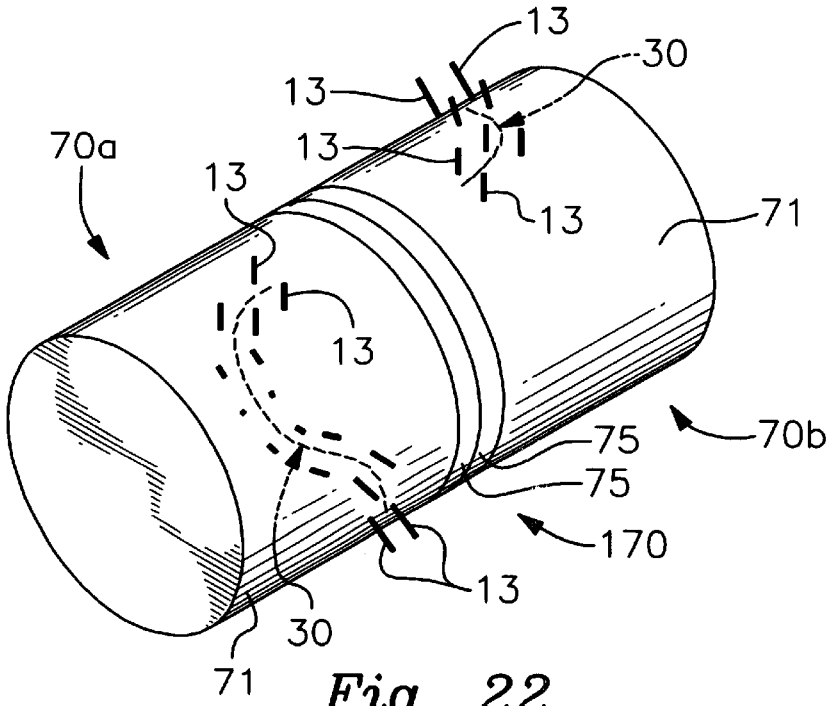
FIG. 22 is a perspective view of a pair of oppositely oriented hemispherical chamber switches, where the sensing pathway is formed by paired contact pins.

FIG. 22 shows a pair of switches 70*a* and 70*b* joined and oriented in opposite directions, where the sensing pathway 30, illustrated by a dashed line, is defined by pairs of electrical contact pin members 13 which are mounted in the outer body 71 of each switch 70. The pin members 13 extend into the chambers 78 to make contact with the gravity responsive member 12, which as stated is preferably a conductive liquid bead 17 disposed within a carrier liquid 18. The contact pin pairs 13 will be joined in an electrical circuit by conductive wire leads, not shown, in known manner. This construction allows the combination switch 170 to operate over a full 360 degrees in all axial directions, As the combination switch 170 is rotated, tilted, moved through space, etc., the pathway 30 defined by one of the individual switches 70*a* or 70*b* is always operational. For example, in FIG. 22, switch 70*a* would be operational. When the switch 170 is inverted such that switch 70*a* is no longer functioning, i.e., such that switch 70*b* occupies the lowermost relative position, the sensing pathway 30 of switch 70*b* becomes operational. Similar double switches having equivalent sensing pathways 30 can be formed using opposing strips 14, suspended wire pairs 16, a single suspended wire 15 in combination with a conductive layer 79 or outer body 71, etc., in the manner described elsewhere herein.

Figure 23:
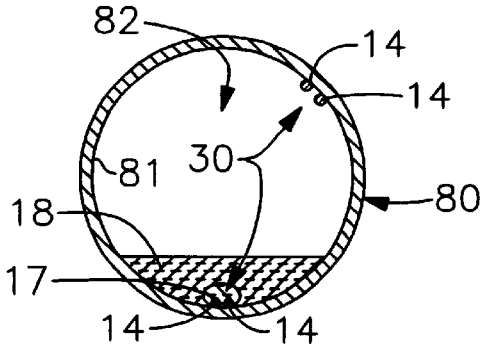
FIG. 23 is a cross-sectional view of a spherical switch, where the sensing pathway is formed by a pair of opposing strips.
Figure 24:
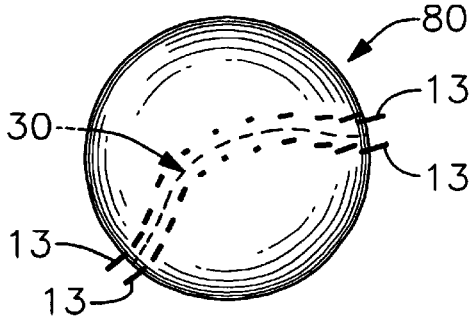
FIG. 24 is an external view of a spherical switch, where the sensing pathway is formed by pairs of contact pins.
Figure 25:
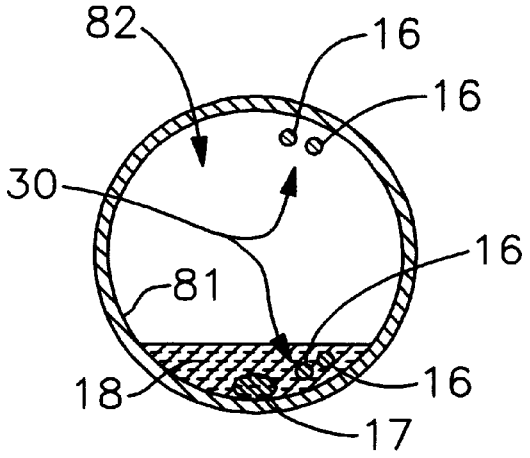
FIG. 25 is a cross-sectional view of a spherical switch, where the sensing pathway is formed by a pair of suspended wires.
Figure 26:
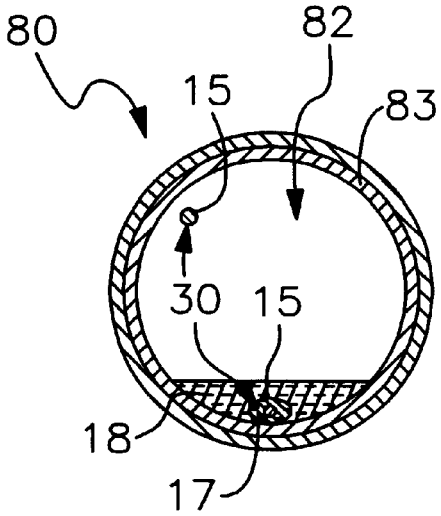
FIG. 26 is a cross-sectional view of a spherical switch, where the sensing pathway is formed by a suspended wire and the chamber outer wall is comprised of a conductive layer.

FIGS. 23 through 26 illustrate another embodiment for a spherical switch 80 operational over a 360 range in all axial directions. Here spherical switch 80 is a hollow sphere having an internal chamber wall 81 defining a spherical interior chamber 82. The sensing pathways 30 are formed within the chamber 82 by any of the described means, such as paired contact pins 13, as shown in FIG. 24, embedded pairs of strips or wires 14, as shown in FIG. 23, or suspended wire pairs 16, as shown in FIG. 25. The electrical circuit is closed when the switch 80 is rotated so that the conductive liquid bead 17 fills the gap between the conductive members. FIG. 26 shows a switch 80 having a conductive interior layer 83 and a single suspended wire contact 15, where the circuit is completed when switch 80 is positioned so that the conductive liquid bead 17 fills the gap between the wire contact 15 and the conductive interior layer 83. In all the embodiments, the contact members are connected in known manner to create an electrical circuit.

Figure 27:
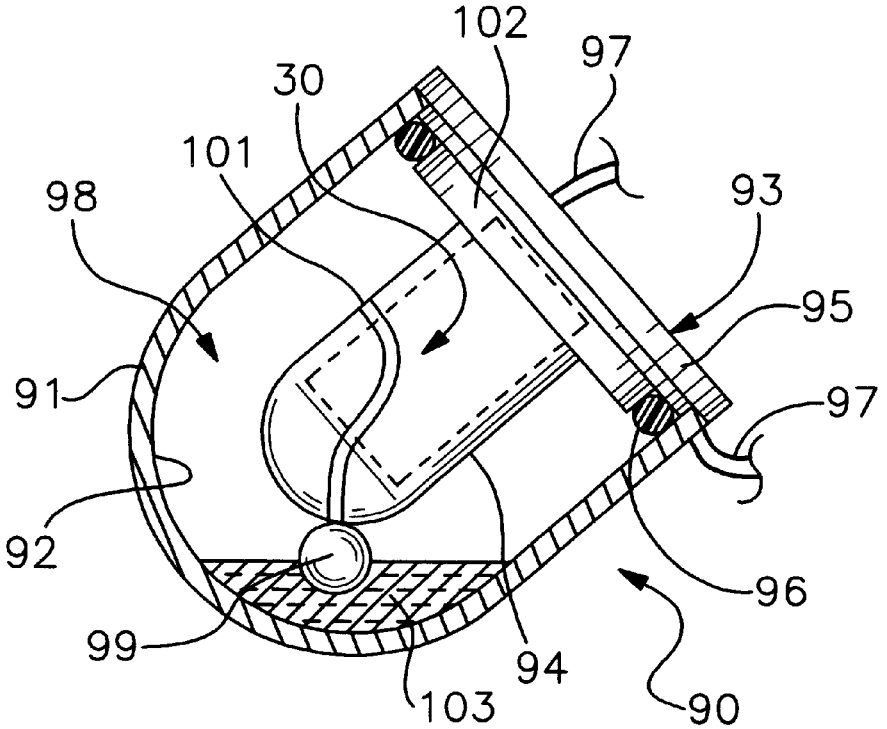
FIG. 27 is a cross-sectional view of a hemispherical switch where a magnet retains a metal ball in contact with the chamber inner wall and a conductive liquid is used to complete a circuit when the ball is in contact with a sensing pathway.

Another embodiment for the three axis switch is shown in FIG. 27. Switch 90 incorporates a magnet 102 disposed within the chamber inner wall 94 of an inner cap member 93, which comprises a sealing flange 95 to mate with an outer body 91 in sealing manner with O-ring 96. The outer body 91 is formed of a conductive material, or a conductive layer is provided on the chamber outer wall 92. A strip 101 composed of a conductive material, such as a metal foil, is embedded on the surface of the chamber inner wall 94 to define the sensing pathway 30. External leads 97 connect to the outer body 91 and the conductive strip 101. A metal ball 99 is disposed against the chamber inner wall 94, where it is held in contact with and suspended from the chamber inner wall 94 by the magnet 102. The metal ball 99 will always occupy the lowermost zero gravity position due to gravity effects as the switch 90 is turned. A conductive liquid 103 is placed into the chamber 98, the liquid 103 being sufficient in quantity to bridge the gap between the metal ball 99 and the chamber outer wall 92, but not in such quantity that the gap between the chamber inner wall 94 and the chamber outer wall 92 is bridged. When the switch 90 is oriented such that the metal ball 99 contacts the foil strip 101, the circuit to the chamber outer wall 92 is completed by the conductive liquid 103. When the switch 90 is oriented such that the metal ball 99 does not contact the strip 101, the circuit is open.

It is understood that certain substitutions and equivalents for elements set forth above may be obvious to those skilled in the art, and thus the true scope and definition of the invention is to be as set forth in the following claims.

I claim:

1. A gravity responsive attitude switch which controls a circuit in response to positioning the switch relative to true vertical comprising:

a housing defining a chamber, said chamber having a concave hemispherical outer wall and a convex hemispherical inner wall;

a conductive pathway disposed within said chamber;

a gravity responsive member free to move within said chamber whereby said gravity responsive member, dependent on the orientation of said switch relative to true vertical, either contacts said pathway forming a closed circuit or does not contact said pathway leaving an open circuit;

where said pathway defines a course of rotation for said switch over all three axial directions regardless of whether said switch remains fixed in space or is moved through space as its position is changed.

2. The switch of claim 1, wherein said conductive pathway is electrically conductive and said gravity responsive member is electrically conductive.

3. The switch of claim 2, wherein said conductive pathway comprises a plural number of paired electrical leads.

4. The switch of claim 3, wherein said paired electrical leads are positioned along a single curvilinear line.

5. The switch of claim 3, wherein said paired electrical leads are positioned along a pair of curvilinear lines, wherein said gravity responsive member contacts said paired electrical leads to complete a circuit when said switch is oriented in a particular manner.

6. The switch of claim 2, wherein said conductive pathway comprises a pair of electrically conductive strips, wherein said gravity responsive member contacts said strips to complete a circuit when said switch is oriented in a particular manner.

7. The switch of claim 2, wherein said gravity responsive member is liquid mercury.

8. The switch of claim 2, wherein said gravity responsive member is a metal ball.

9. The switch of claim 1, wherein said conductive pathway is optically conductive.

10. The switch of claim 9, wherein said conductive pathway comprises paired sets of light emitters and light receivers, wherein for each said emitter and receiver pair the emitter is positioned opposite the receiver, and wherein said gravity responsive member is opaque so that contact with said pathway blocks light emitted from at least one said light emitter.

11. The switch of claim 1, wherein said pathway extends in all three axial directions.

12. The switch of claim 1, wherein said gravity responsive member is composed of an electrically conductive liquid, wherein said electrically conductive liquid is immersed within a non-conductive carrier liquid, said electrically conductive liquid being immiscible within said carrier liquid of different density than said carrier liquid, such that said electrically conductive liquid forms a bead within said carrier liquid.

13. The switch of claim 12, wherein said electrically conductive liquid is chosen from the group of liquids consisting of propylene glycol and silver nitrate, and where said carrier liquid is chosen from the group of liquids consisting of silicone oil, benzene and toluene.

14. The switch of claim 12, wherein said switch comprises an electrical circuit which senses the difference in resistance between the electrically conductive liquid and the carrier liquid, said electrical circuit determining the operational status of said switch.

15. The switch of claim 1, wherein said conductive pathway is disposed on said chamber inner wall.

16. The switch of claim 1, wherein said outer chamber wall is formed of a conductive material, and said conductive pathway is defined by a plural number of pins disposed on said chamber inner wall.

17. A gravity responsive attitude switch comprising:

a chamber defined by a concave hemispherical outer wall and a convex hemispherical inner wall;

a conductive pathway disposed within said chamber; and a gravity responsive member free to move within said chamber whereby said gravity responsive member either contacts said pathway forming a closed circuit or does not contact said pathway leaving an open circuit.

18. The switch of claim 17, wherein said conductive pathway is electrically conductive and said gravity responsive member is electrically conductive.

19. The switch of claim 17, wherein said gravity responsive member is liquid mercury.

20. The switch of claim 17, wherein said gravity responsive member is a metal ball.

21. The switch of claim 17, wherein said conductive pathway is optically conductive.

22. The switch of claim 17, wherein said pathway extends in all three axial directions.

23. The switch of claim 17, wherein said conductive pathway is disposed on said chamber inner wall.

24. The switch of claim 17, wherein said conductive pathway is disposed on said chamber outer wall.

25. A gravity responsive attitude switch which controls a circuit in response to positioning the switch relative to true vertical comprising:

a housing defining a chamber, said chamber having a concave hemispherical outer wall;

a conductive pathway disposed within said chamber;

a gravity responsive member free to move within said chamber whereby said gravity responsive member, dependent on the orientation of said switch relative to true vertical, either contacts said pathway forming a closed circuit or does not contact said pathway leaving an open circuit, wherein said gravity responsive member is composed of an electrically conductive liquid, wherein said electrically conductive liquid is immersed within a non-conductive carrier liquid, said electrically conductive liquid being immiscible within said carrier liquid of different density than said carrier liquid, such that said electrically conductive liquid forms a bead within said carrier liquid, wherein said electrically conductive liquid is chosen from the group of liquids consisting of propylene glycol and silver nitrate, and where said carrier liquid is chosen from the group of liquids consisting of silicone oil, benzene and toluene;

where said pathway defines a course of rotation for said switch over all three axial directions regardless of whether said switch remains fixed in space or is moved through space as its position is changed.

* * * * *